US009478156B2

(12) United States Patent
Jeong et al.

(10) Patent No.: US 9,478,156 B2
(45) Date of Patent: Oct. 25, 2016

(54) ORGANIC LIGHT EMITTING DISPLAY DEVICE AND DRIVING METHOD THEREOF

(71) Applicant: LG Display Co., Ltd., Seoul (KR)

(72) Inventors: Uitaek Jeong, Seoul (KR); Boeon Byeon, Gwangju (KR)

(73) Assignee: LG DISPLAY CO., LTD., Seoul (KR)

( * ) Notice: Subject to any disclaimer, the term of this patent is extended or adjusted under 35 U.S.C. 154(b) by 83 days.

(21) Appl. No.: 14/055,531

(22) Filed: Oct. 16, 2013

(65) Prior Publication Data

US 2014/0176617 A1 Jun. 26, 2014

(30) Foreign Application Priority Data

Dec. 21, 2012 (KR) ..... 10-2012-0150275

(51) Int. Cl.

*G09G 3/36* (2006.01)
*G09G 3/20* (2006.01)
*G09G 3/32* (2016.01)

(52) U.S. Cl.

CPC ..... *G09G 3/2003* (2013.01); *G09G 3/3225* (2013.01); *G09G 2300/0452* (2013.01); *G09G 2320/0285* (2013.01); *G09G 2320/048* (2013.01); *G09G 2320/0666* (2013.01); *G09G 2340/06* (2013.01)

(58) Field of Classification Search

CPC ..... G09G 3/30; G09G 2320/02; G09G 2320/0242; G09G 2320/45
USPC ..... 345/603, 690, 82; 348/649
See application file for complete search history.

(56) References Cited

U.S. PATENT DOCUMENTS

2006/0268003 A1* 11/2006 Tanase et al. ..... 345/603
2007/0024557 A1 2/2007 Rho et al.
2008/0068310 A1* 3/2008 Choi et al. ..... 345/82
2009/0207182 A1 8/2009 Takada et al.
2011/0149166 A1* 6/2011 Botzas et al. ..... 348/649
2011/0221792 A1 9/2011 Maeda et al.

FOREIGN PATENT DOCUMENTS

CN 1905621 A 1/2007
CN 101510389 A 8/2009
CN 102194429 A 9/2011

* cited by examiner

*Primary Examiner* — Andrew Sasinowski
*Assistant Examiner* — Kuo Woo
(74) *Attorney, Agent, or Firm* — Dentons US LLP

(57) ABSTRACT

Disclosed is an organic light emitting display device. The organic light emitting display device includes a display panel arranged to include a plurality of unit pixels having red, green, blue, and white sub-pixels, a four-color data converter configured to convert input data of red, green, and blue of each unit pixel into data of red, green, blue, and white respectively corresponding to the red, green, blue, and white sub-pixels, and a panel driver configured to accumulate data of each of the sub-pixels at every accumulation period, store the accumulated data in a memory, decide a color correction mode for correcting a color of each unit pixel on the basis of the accumulated data of the white sub-pixel stored in the memory, drive the white sub-pixel of each unit pixel according to the decided color correction mode, and selectively drive the red, green, and blue sub-pixels.

11 Claims, 5 Drawing Sheets

ORGANIC LIGHT EMITTING DISPLAY DEVICE AND DRIVING METHOD THEREOF

CROSS-REFERENCE TO RELATED APPLICATIONS

This application claims the benefit of the Korean Patent Application No. 10-2012-0150275 filed on Dec. 21, 2012, which is hereby incorporated by reference for all purposed as if fully set forth herein.

BACKGROUND OF THE INVENTION

1. Field of the Invention

The present invention relates to an organic light emitting display device including a plurality of white sub-pixels.

2. Discussion of the Related Art

With the advancement of multimedia, the importance of flat panel display (FPD) devices is increasing. Therefore, various FPD devices such as liquid crystal display (LCD) devices, plasma display panel (PDP) devices, and organic light emitting display devices are being practically used. In such FPD devices, organic light emitting display devices have a fast response time, and have no limitation in a viewing angle because the organic light emitting display devices self-emit light. Accordingly, the organic light emitting display devices are attracting much attention as next generation FPD devices.

In general organic light emitting display devices, one unit pixel is configured with a red (R), green (G), and blue (B) sub-pixels, and an image of various colors is displayed through three sub-pixels.

Recently, a four-color organic light emitting display device in which a white (W) sub-pixel is added to a unit pixel is being developed to increase a luminance of the unit pixel. The four-color organic light emitting display device converts three-color input data of red, green, and blue into four-color data of red, green, blue, and white to display an image.

In driving a white color, a related art four-color organic light emitting display device continuously emits light from a white sub-pixel, and selectively emits light from two of red, green, and blue sub-pixels, thereby realizing a desired white color. That is, the related art organic light emitting display device generates, as white output data, the minimum grayscale value among input data of red, green, and blue, and subtracts the white output data from three-color input data of red, green, and blue to generate three-color output data of red, green, and blue. For example, in FIG. 1, when three-color input data Ri, Gi and Bi are composed of 20 (Ri), 30 (Gi), and 35 (Bi), the related art four-color organic light emitting display device converts the three-color input data Ri, Gi and Bi into four-color output data Ro, Go, Bo and Wo composed of 0 (Ro), 10 (Go), 15 (Bo), and 20 (Wo).

The above-described four-color organic light emitting display device was proposed on the assumption that color coordinates of a white sub-pixel are uniform. However, since a white organic light emitting element included in the white sub-pixel continuously emits light unlike other sub-pixels, the white organic light emitting element can be deteriorated relatively earlier than the other sub-pixels according to a material characteristic and an emission time, and a deterioration of the white organic light emitting element causes a reduction in white luminance and a change in color coordinates.

For this reason, in the related art four-color organic light emitting display device, color coordinates (CIEx, CIEy) are shifted depending on the deterioration of the white organic light emitting element to cause a yellowish image, and the change in color coordinates is shown like image sticking.

SUMMARY OF THE INVENTION

Accordingly, the present invention is directed to an organic light emitting display device including a plurality of white sub-pixels and a driving method thereof that substantially obviate one or more problems due to limitations and disadvantages of the related art.

An advantage of the present invention is to provide an organic light emitting display device including a plurality of white sub-pixels and a driving method thereof which can prevent a change in color coordinates due to a deterioration of a white organic light emitting element and image sticking caused by the change.

Additional advantages and features of the invention will be set forth in part in the description which follows and in part will become apparent to those having ordinary skill in the art upon examination of the following or may be learned from practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a display panel arranged to include a plurality of unit pixels having red, green, blue, and white sub-pixels including different organic light emitting elements; a four-color data converter configured to convert input data of red, green, and blue of each of the plurality of unit pixels into data of red, green, blue, and white respectively corresponding to the red, green, blue, and white sub-pixels of each unit pixel; and a panel driver configured to accumulate data of each of the sub-pixels supplied from the four-color data converter at every accumulation period, store the accumulated data in a memory, decide a color correction mode for correcting a color of each unit pixel on the basis of the accumulated data of the white sub-pixel stored in the memory, drive the white sub-pixel of each unit pixel according to the decided color correction mode, and selectively drive the red, green, and blue sub-pixels simultaneously with the driving of the white sub-pixel.

In another aspect of the present invention, there is provided a method of driving an organic light emitting display device, including a unit pixel having red, green, blue, and white sub-pixels including different organic light emitting elements, including: performing an A operation of converting input data of red, green, and blue of the unit pixel into data of red, green, blue, and white respectively corresponding to the red, green, blue, and white sub-pixels of the unit pixel; performing a B operation of accumulating data of each of the sub-pixels supplied from the four-color data converter at every accumulation period, and storing the accumulated data in a memory; and performing a C operation of deciding a color correction mode for correcting a color of the unit pixel on the basis of the accumulated data of the white sub-pixel stored in the memory, driving the white sub-pixel according to the decided color correction mode, and selectively driving the red, green, and blue sub-pixels simultaneously with the driving of the white sub-pixel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, an organic light emitting display device and a driving method thereof according to the present invention will be described in detail with reference to the accompanying drawings.

Figure 1:
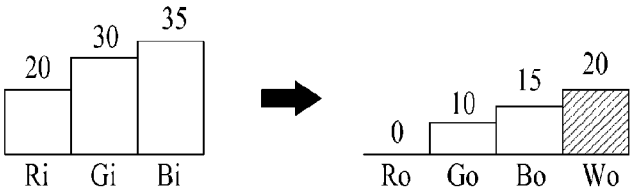
FIG. 1 Related Art
FIG. 1 is a diagram describing a method of converting three-color data into four-color data in a related art organic light emitting display device.
Figure 2:
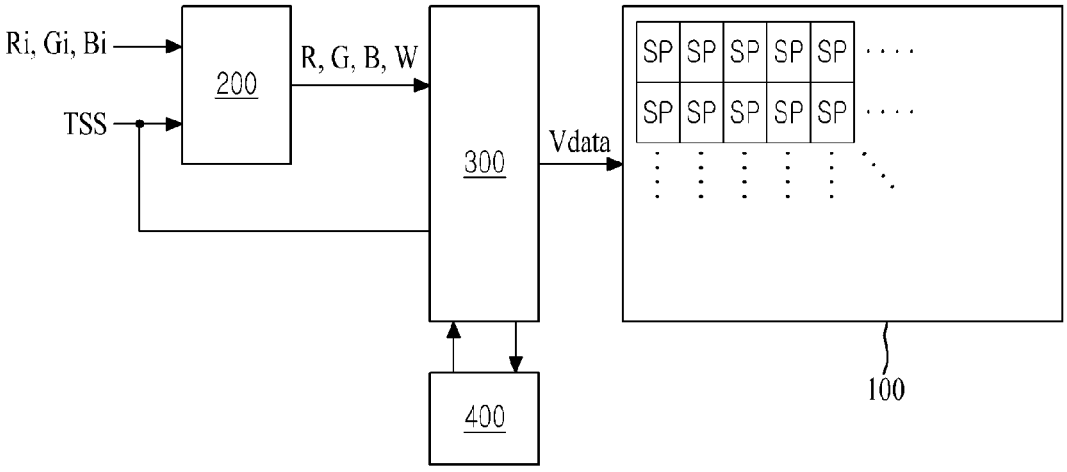
FIG. 2 is a diagram describing an organic light emitting display device according to an embodiment of the present invention.
Figure 3:
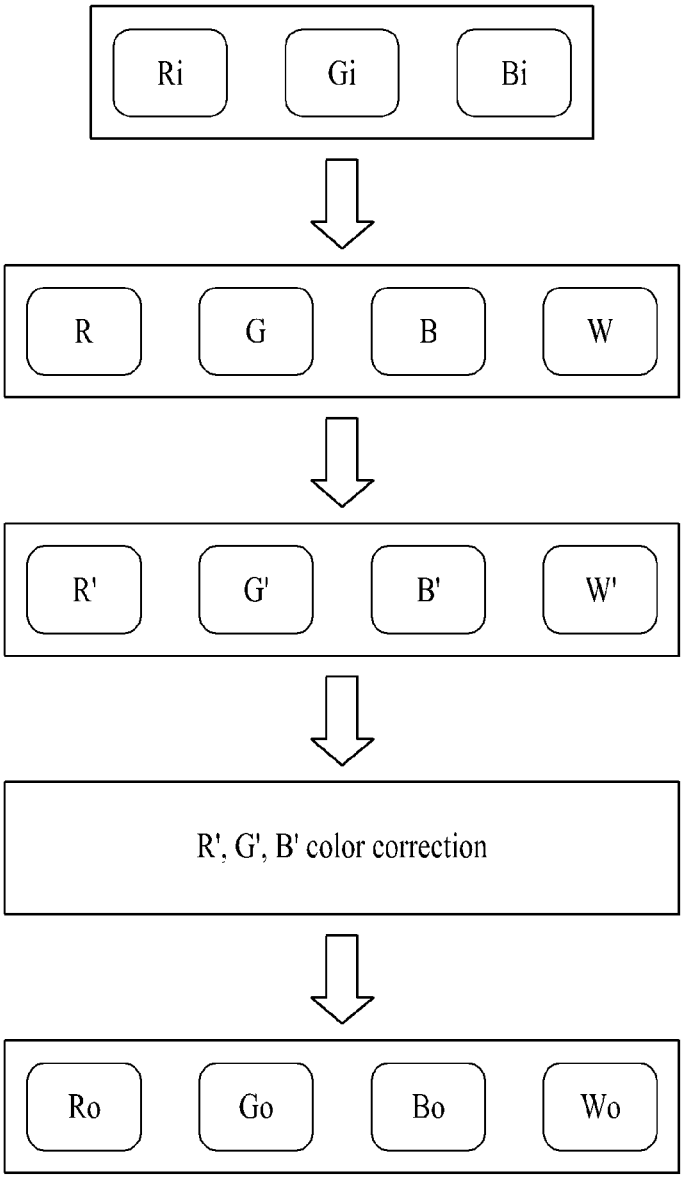
FIG. 3 is a diagram conceptually illustrating a data processing operation performed in a panel driver of FIG. 2.

FIG. 2 is a diagram for describing an organic light emitting display device according to an embodiment of the present invention, and FIG. 3 is a diagram conceptually illustrating a data processing operation performed in a panel driver of FIG. 2.

Referring to FIGS. 2 and 3, the organic light emitting display device according to an embodiment of the present invention includes a display panel 100, a four-color data converter 200, a panel driver 300, and a memory 400.

The display panel 100 includes a plurality of sub-pixels SP, each of which includes an organic light emitting element.

The organic light emitting element included in each sub-pixel SP emits light with a data current output from a driving transistor included in each sub-pixel SP. Here, each sub-pixel SP may be one of a red sub-pixel, a green sub-pixel, a blue sub-pixel, and a white sub-pixel. One unit pixel that displays one image includes adjacent red sub-pixel, green sub-pixel, blue sub-pixel, and white sub-pixel.

The four-color data converter 200 generates four-color data R, G, B and W of red, green, blue, and white to be respectively supplied to a red sub-pixel, a green sub-pixel, a blue sub-pixel, and a white sub-pixel, which configure one unit pixel of the display panel 100, on the basis of three-color input data Ri, Gi and Bi of red, green, and blue according to a timing sync signal (TSS) input from an external system body (not shown) or a graphics card (not shown), and supplies the four-color data R, G, B and W to the panel driver 300. For example, the four-color data converter 200 generates, as white data W, input data having the minimum grayscale value among the three-color input data Ri, Gi and Bi, subtracts the white data W from each of the three-color input data Ri, Gi and Bi to generate data R, G and B of red, green, and blue, converts the three-color input data Ri, Gi and Bi into the four-color data R, G, B and W, and supplies the four-color data R, G, B and W to the panel driver 300. Here, one of the data R, G and B of red, green, and blue has a grayscale value of 0 or black.

The panel driver 300 accumulates data R, G, B and W of the respective sub-pixels SP supplied from the four-color data converter 200 in units of a sub-pixel SP at every frame or accumulation period set as a certain period, stores the accumulated data in the memory 400, modulates the data of each sub-pixel SP on the basis of the accumulated data of each sub-pixel SP stored in the memory 400 at every frame or deterioration compensation period set as a certain period to generate modulation data R', G', B' and W' of the respective sub-pixels SP, compares a predetermined color correction reference value with the accumulated data of a white sub-pixel stored in the memory 400, and drives all or three sub-pixels including the white sub-pixel of four sub-pixels configuring each unit pixel according to the compared result.

Specifically, when the accumulated data of the white sub-pixel are less than the color correction reference value, the panel driver 300 converts the modulation data R', G', B' and W' of the respective sub-pixels SP into data voltages Vdata, and supplies the data voltages to three sub-pixels including a white sub-pixel among red, green, blue, and white sub-pixels of each unit pixel, thereby selectively driving the three sub-pixels including the white sub-pixel of each unit pixel. In this case, in each unit pixel, two sub-pixels selected from among red, green, and blue sub-pixels and a white sub-pixel are only driven with the data voltages Vdata based on the modulation data R', G', B' and W' of the respective sub-pixels SP.

On the other hand, when the accumulated data of the white sub-pixel exceeds the color correction reference value, as illustrated in FIG. 3, the panel driver 300 color-corrects modulation data R', G' and B' of red, green, and blue with modulation data W' of a white sub-pixel for each unit pixel to generate four-color output data Ro, Go, Bo and Wo composed of white modulation data W' and color correction data Ro, Go and Bo of red, green, and blue, converts the four-color output data Ro, Go, Bo and Wo of each unit pixel into data voltages Vdata, and supplies the data voltages Vdata to the respective sub-pixels, thereby simultaneously driving four sub-pixels of each unit pixel. In this case, in each unit pixel, all sub-pixels of red, green, blue, and white are simultaneously driven with the data voltages Vdata based on the four-color output data Ro, Go, Bo and Wo, respectively.

When the white organic light emitting element included in each white sub-pixel reaches a predetermined deterioration correction time, the panel driver 300 drives all sub-pixels of each unit pixel. At this time, the panel driver 300 color-corrects and drives three-color data to be supplied to red, green, and blue sub-pixels to correct a change in color coordinates due to a deterioration of the white organic light emitting element, and thus removes image sticking caused by the change in color coordinates.

Hereinafter, the organic light emitting display device having the above-described features and a driving method thereof will be described with reference to FIGS. 4 to 8 as an example.

Figure 4:
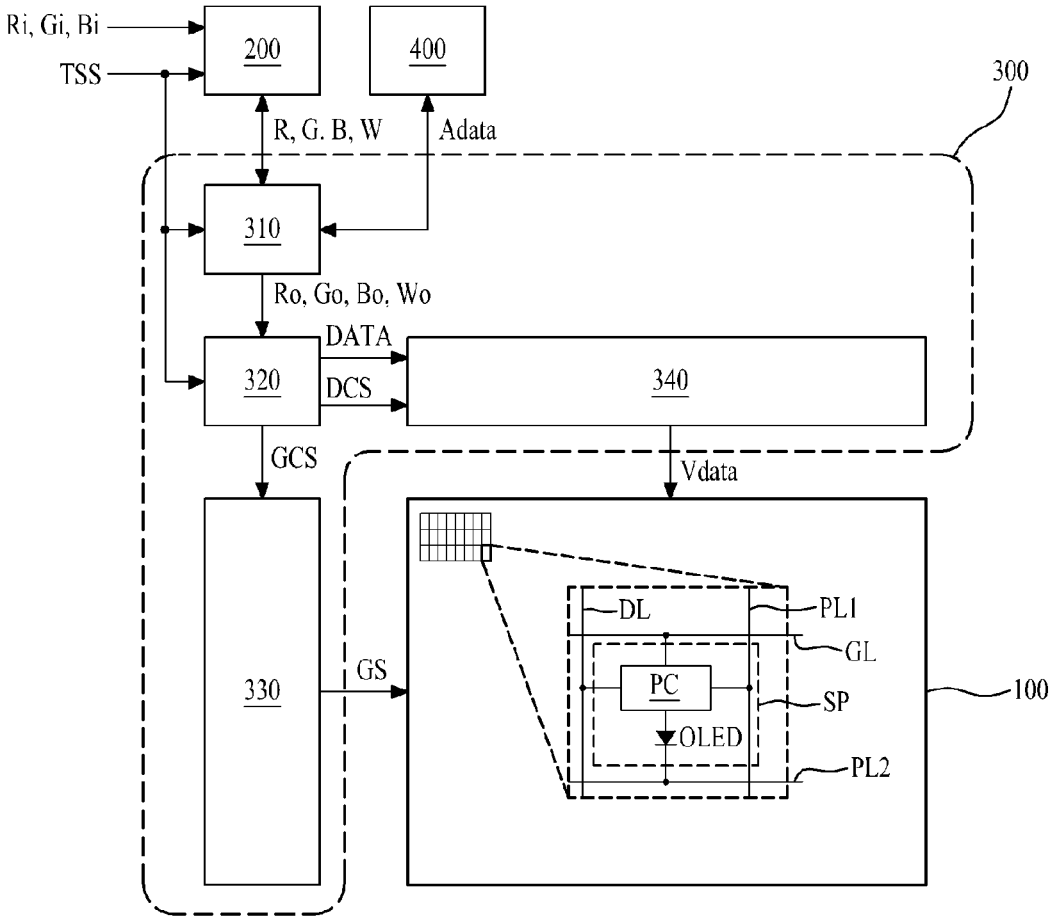
FIG. 4 is a diagram describing a configuration of the organic light emitting display device according to an embodiment of the present invention.
Figure 5:
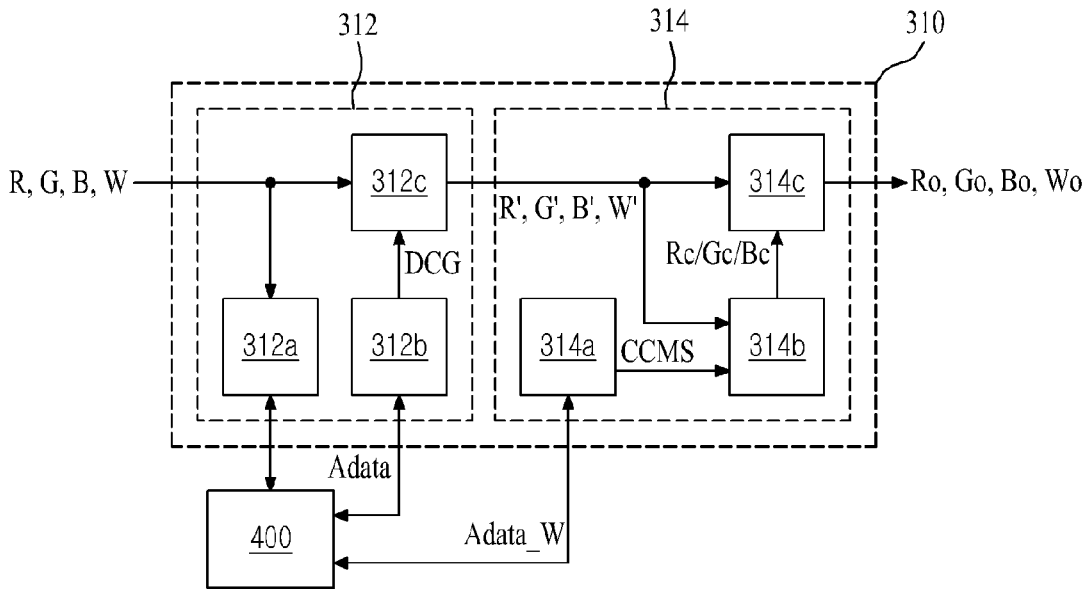
FIG. 5 is a block diagram describing a configuration of a data modulator of FIG. 4.

FIG. 4 is a diagram for describing a configuration of the organic light emitting display device according to an embodiment of the present invention, and FIG. 5 is a block diagram for describing a configuration of a data modulator of FIG. 4.

Referring to FIGS. 4 and 5, the organic light emitting display device according to an embodiment of the present invention includes the display panel 100, the four-color data converter 200, the panel driver 300, and the memory 400.

The display panel 100 includes the plurality of sub-pixels SP. The plurality of sub-pixels SP are respectively formed in a plurality of pixel areas defined by intersections between a plurality of gate lines GL and a plurality of data lines DL. A plurality of driving voltage lines PL1, which receive a driving voltage from the panel driver 300, are formed in parallel to the plurality of data lines DL in the display panel 100.

Each of the plurality of sub-pixels SP may be one of red, green, blue, and white sub-pixels. One unit pixel displaying one image may include adjacent red, green, blue, and white sub-pixels, or include red, green, and blue sub-pixels. Hereinafter, one unit pixel is assumed as including red, green, blue, and white sub-pixels.

Each of the plurality of sub-pixels SP includes the organic light emitting element OLED and a pixel circuit PC.

The organic light emitting element OLED is connected to the pixel circuit PC and a corresponding second power line PL2, and emits light in proportion to an amount of data current supplied from the pixel circuit PC to emit certain color light. To this end, the organic light emitting element OLED includes an anode electrode (a pixel electrode) connected to the pixel circuit PC, a cathode electrode (a reflective electrode) connected to the second power line PL2, and an emission cell that is formed between the anode electrode and the cathode electrode to emit light of one of red, green, blue, and white. Here, the emission cell may be formed to have a structure of a hole transport layer/organic emission layer/electron transport layer or a structure of a hole injection layer/hole transport layer/organic emission layer/electron transport layer/electron injection layer. Further, the emission cell may further include a function layer for enhancing the emission efficiency and/or service life of the organic emission layer.

The compensation circuit using the internal compensation scheme is configured with at least one compensation transistor and at least one compensation capacitor which are formed in the pixel circuit PC. The compensation circuit using the internal compensation scheme is a scheme that stores both a data voltage and the threshold voltage of the driving transistor in the capacitor during a detection period in which the threshold voltage of the driving transistor is detected, and compensates for the threshold voltage of the driving transistor. Here, the switching transistor and the driving transistor may be an a-Si thin film transistor (TFT), a poly-Si TFT, an oxide TFT, or an organic TFT.

The switching transistor supplies the data voltage Vdata, supplied to the data line DL, to a gate of the driving transistor according to the gate-on voltage level of gate signal supplied to the gate line GL.

The driving transistor is turned on with a gate-source voltage including the data voltage Vdata supplied from the switching transistor, and controls an amount of current flowing from the driving voltage line PL1 to the organic light emitting element OLED.

The capacitor is connected between a gate and source of the driving transistor. The capacitor is charged with a difference voltage between the gate and source of the driving transistor, and then turns on the driving transistor with the charged voltage.

The numbers of transistors and capacitors configuring the above-described pixel circuit PC may be variously changed.

The four-color data converter 200 generates four-color data R, G, B and W of red, green, blue, and white to be respectively supplied to a red sub-pixel, a green sub-pixel, a blue sub-pixel, and a white sub-pixel, which configure one unit pixel of the display panel 100, on the basis of three-color input data Ri, Gi and Bi of red, green, and blue according to the timing sync signal TSS inputted from the external system body (not shown) or the graphics card (not shown), and supplies the four-color data R, G, B and W to the panel driver 300.

The panel driver 300 accumulates data R, G, B and W of the respective sub-pixels SP supplied from the four-color data converter 200 in units of a sub-pixel SP at every frame or accumulation period set as a certain period, stores the accumulated data in the memory 400, modulates the data of each sub-pixel SP on the basis of the accumulated data of each sub-pixel SP stored in the memory 400 to generate modulation data R', G', B' and W' of the respective sub-pixels SP, decides a color correction mode for three-color modulation data R', G' and B' of each unit pixel on the basis of the accumulated data of the white sub-pixel stored in the memory 400, and drives all or three sub-pixels including the white sub-pixel of four sub-pixels configuring each unit pixel according to the color correction mode. At this time, the color correction mode may be applied at different times for each unit pixel according to the accumulated data of the white pixel of each unit pixel. To this end, the panel driver 300 includes a data modulator 310, a timing controller 320, a gate driving circuit 330, and a data driving circuit 340.

The data modulator 310, as illustrated in FIG. 5, includes a deterioration compensator 312 and a color corrector 314.

The deterioration compensator 312 accumulates data R, G, B and W of the respective sub-pixels SP supplied from the four-color data converter 200 in units of a sub-pixel SP at every frame or accumulation period set as a certain period, stores the accumulated data in the memory 400, calculates a deterioration compensation gain value DCG for each sub-pixel SP on the basis of the accumulated data of each sub-pixel SP stored in the memory 400, and modulates the data of each sub-pixel SP by using the deterioration compensation gain value DCG to generate modulation data R', G', B' and W' of the respective sub-pixels SP. To this end, the deterioration compensator 312 includes a data accumulating unit 312*a*, a deterioration compensation value calculating unit 312*b*, and a data modulating unit 312*c*.

The data accumulating unit 312*a* accumulates data R, G, B and W of the respective sub-pixels SP supplied from the four-color data converter 200 in units of a sub-pixel SP, and stores the accumulated data in the memory 400. That is, the data accumulating unit 312*a* reads accumulated data Adata of a corresponding sub-pixel SP corresponding to input data R, G, B and W of the respective sub-pixels SP, accumulates the data R, G, B and W to the read accumulated data Adata of the corresponding sub-pixel SP, and again stores accumulated data Adata of the corresponding sub-pixel SP accumulated until a current frame.

The deterioration compensation gain value calculating unit 312*b* calculates the deterioration compensation gain value DCG for compensating for a deterioration caused by a driving time (amount) of the organic light emitting element OLED included in each sub-pixel SP on the basis of the accumulated data of each sub-pixel SP stored in the memory 400 at every frame or deterioration compensation period set as a certain period.

Figure 6:
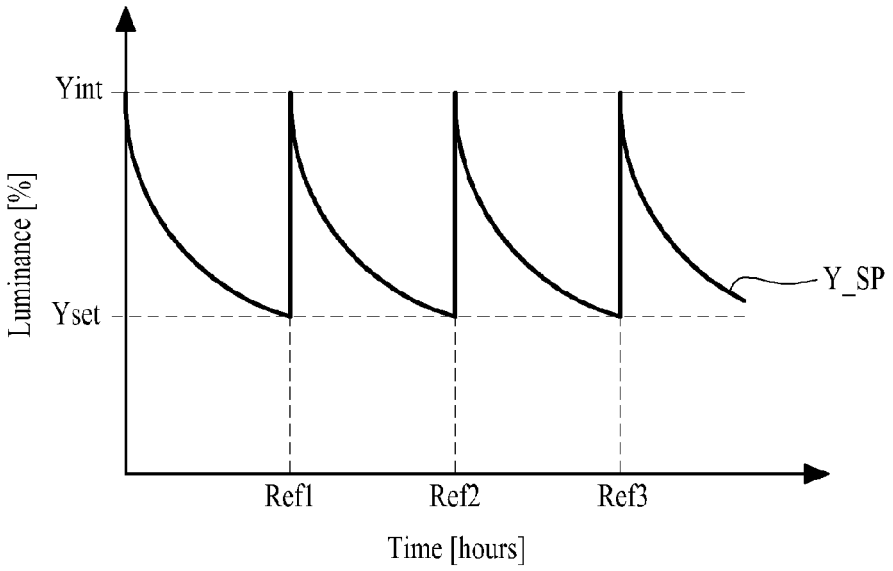
FIG. 6 is a diagram describing a method of calculating a deterioration compensation gain value according to a first embodiment of the present invention.

The deterioration compensation gain value calculating unit 312*b* according to a first embodiment, as illustrated in FIG. 6, may calculate the deterioration compensation gain value DCG of each sub-pixel SP for increasing a luminance A of each sub-pixel SP to a predetermined initial luminance Yint on the basis of the accumulated data of each sub-pixel SP stored in the memory 400. For example, the deterioration compensation gain value calculating unit 312*b* according to the first embodiment respectively compares the accumulated data of each sub-pixel SP with a plurality of predetermined compensation time accumulation data Ref1, Ref2 and Ref3, and when the accumulated data of each sub-pixel SP are equal to or greater than the plurality of predetermined compensation time accumulation data Ref1, Ref2 and Ref3, the deterioration compensation gain value calculating unit 312*b* calculates the deterioration compensation gain value DCG for increasing a luminance A of a corresponding sub-pixel SP to the predetermined initial luminance Yint.

Each of the plurality of predetermined compensation time accumulation data Ref1, Ref2 and Ref3 is prediction accumulation data having a progressively increasing value so as to correspond to a predetermined luminance reduction value Yset with respect to the initial luminance Yint of the organic light emitting element OLED, and may be set from a relationship or a lookup table composed of prediction accumulation data for a certain luminance reduction time with respect to the initial luminance Yint of the organic light emitting element OLED. Further, the deterioration compensation gain value calculating unit 312*b* according to the first embodiment may be configured with the lookup table to which the deterioration compensation gain value DCG having a real number value exceeding one according to accumulated data is mapped, or may be configured with an operation logic that performs an arithmetic operation for calculating the deterioration compensation gain value DCG having a real number value exceeding one according to accumulated data.

As a result, the deterioration compensation gain value calculating unit 312*b* according to the first embodiment repeatedly performs the above-described operation, and thus, whenever the accumulated data of each sub-pixel SP are equal to or greater than the plurality of predetermined compensation time accumulation data Ref1, Ref2 and Ref3, the deterioration compensation gain value calculating unit 312*b* generates the deterioration compensation gain value DCG having a real number value exceeding one.

Figure 7:
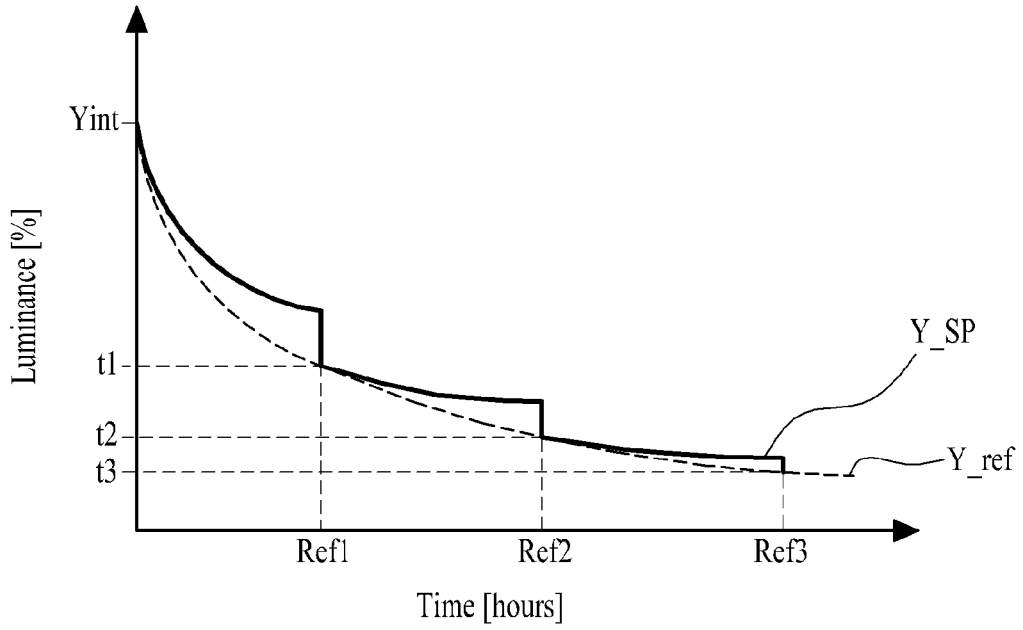
FIG. 7 is a diagram describing a method of calculating a deterioration compensation gain value according to a second embodiment of the present invention.

A deterioration compensation gain value calculating unit 312*b* according to a second embodiment, as illustrated in FIG. 7, calculates a deterioration compensation gain value DCG of each sub-pixel SP for decreasing a luminance Y_SP of each sub-pixel SP to the same luminance as a luminance Y_ref of a sub-pixel having the most deteriorated organic light emitting element OLED on the basis of the accumulated data of each sub-pixel SP stored in the memory 400. For example, the deterioration compensation gain value calculating unit 312*b* according to the second embodiment extracts the maximum accumulated data having the maximum value from among the accumulated data of each sub-pixel SP stored in the memory 400, respectively compares the extracted maximum accumulated data with a plurality of predetermined compensation time accumulation data Ref1, Ref2 and Ref3, and when the maximum accumulated data are equal to or greater than the plurality of predetermined compensation time accumulation data Ref1, Ref2 and Ref3, the deterioration compensation gain value calculating unit 312*b* calculates the deterioration compensation gain value DCG of each sub-pixel SP on the basis of a difference value between the maximum accumulated data and the accumulated data of each sub-pixel SP.

Each of the plurality of predetermined compensation time accumulation data Ref1, Ref2 and Ref3 is prediction accumulation data corresponding to predetermined luminance reduction times t1 to t3 with respect to the initial luminance Yint of the organic light emitting element OLED, and may be set from a relationship or a lookup table for calculating prediction accumulation data for a certain luminance reduction time with respect to the initial luminance Yint of the organic light emitting element OLED. Further, the deterioration compensation gain value calculating unit 312*b* according to the second embodiment may be configured with the lookup table to which the deterioration compensation gain value DCG having a real number value less than one based on a difference value between accumulated data and the maximum accumulated data is mapped, or may be configured with an operation logic that performs an arithmetic operation for calculating the deterioration compensation gain value DCG having a real number value less than one based on the difference value between the accumulated data and the maximum accumulated data.

As a result, the deterioration compensation gain value calculating unit 312*b* according to the second embodiment repeatedly performs the above-described operation, and thus, whenever the deterioration compensation reference data is equal to or greater than the plurality of predetermined compensation time accumulation data Ref1, Ref2 and Ref3, the deterioration compensation gain value calculating unit 312*b* generates the deterioration compensation gain value DCG of each sub-pixel SP having a real number value less than one according to a difference value between the deterioration compensation reference data and the accumulated data of the sub-pixel SP, and performs adjustment in order for the luminance Y_SP of each sub-pixel SP to become equal to a luminance Y_ref of a reference sub-pixel SP.

Figure 8:
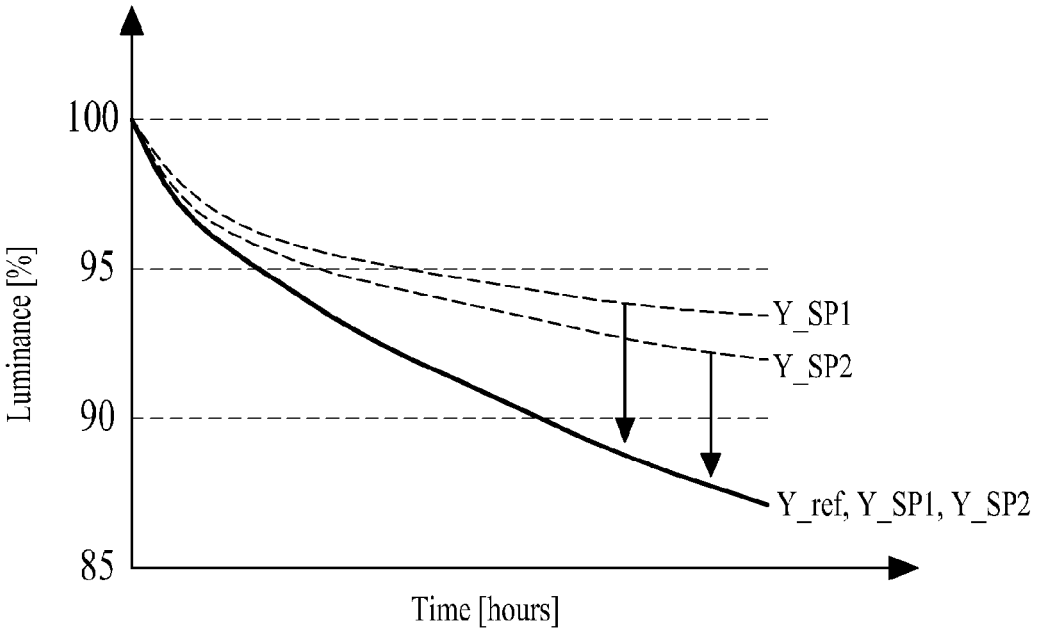
FIG. 8 is a diagram describing a method of calculating a deterioration compensation gain value according to a third embodiment of the present invention.

A deterioration compensation gain value calculating unit 312*b* according to a second embodiment, as illustrated in FIG. 8, extracts the maximum accumulated data having the maximum value from among accumulated data of all sub-pixels SP stored in the memory 400 at every deterioration compensation time to set the maximum accumulated data to reference accumulated data, calculates an accumulation difference value between accumulated data of the respective sub-pixels SP with respect to the reference accumulated data, and calculates a deterioration compensation gain value DCG of each sub-pixel SP according to the calculated accumulation difference value of the respective sub-pixels SP. Here, the deterioration compensation gain value DCG of each sub-pixel SP is set such that luminance Y_SP1 and Y_SP2 of a sub-pixel having the accumulation difference value decreases to a luminance Y_ref of a sub-pixel having the maximum accumulated data, and for example, the deterioration compensation gain value DCG of each sub-pixel SP may be set to a real number value less than one exceeding zero. The deterioration compensation gain value DCG of each sub-pixel SP is differently calculated according to the accumulation difference value of the respective sub-pixels SP, and is updated to a new value by the above-described calculating operation at every deterioration compensation time.

The deterioration compensation gain value calculating unit 312*b* may calculate the deterioration compensation gain value DCG of each sub-pixel SP by using various algorithms in addition to the above-described method of calculating the deterioration compensation gain value DCG.

Referring again to FIGS. 4 and 5, the data modulating unit 312*c* modulates data R, G, B and W of the respective sub-pixels SP on the basis of the deterioration compensation gain value DCG of each sub-pixel SP supplied from the deterioration compensation gain value calculating unit 312*b* to generate modulation data R', G', B' and W' of the respective sub-pixels SP. For example, the data modulating unit 312*c* may multiply the data R, G, B and W of the respective sub-pixels SP by a corresponding deterioration compensation gain value DCG to generate the modulation data R', G', B' and W' of the respective sub-pixels SP, or may generate the modulation data R', G', B' and W' through other arithmetic operations without being limited thereto.

The color corrector 314 decides a color correction mode for three-color modulation data R', G' and B' of each unit pixel on the basis of the accumulated data of a white sub-pixel stored in the memory 400, and generates four-color correction data Ro, Go, Bo and Wo of each unit pixel for driving all or three sub-pixels including the white sub-pixel of four sub-pixels configuring each unit pixel according to the color correction mode. To this end, the color corrector 314 includes a color correction mode deciding unit 314*a*, a three-color correction value generating unit 314*a*, and a data correcting unit 413*c*.

The color correction mode deciding unit 314*a* decides a color correction mode for three-color modulation data R', G' and B' of each unit pixel on the basis of the accumulated data of the white sub-pixel stored in the memory 400, and supplies a color correction mode signal CCMS having a first or second logic level to the three-color correction value generating unit 314*b*. For example, when accumulated data Adata_W of each white sub-pixel are less than a predetermined white deterioration reference value, the color correction mode deciding unit 314*a* generates the color correction mode signal CCMS having the first logic level. On the other hand, when the accumulated data Adata_W of each white sub-pixel are equal to or greater than the predetermined white deterioration reference value, the color correction mode deciding unit 314*a* generates the color correction mode signal CCMS having the second logic level. Here, the white deterioration reference value may be set to prediction accumulation data in which a luminance of the white sub-pixel corresponds to a certain luminance reduction time with respect to an initial luminance. That is, the white deterioration reference value may be set to experimental white accumulated data at a time when a yellowish image occurs because color coordinates (CIEx, CIEy) are shifted due to a deterioration of the white organic light emitting element of the white sub-pixel.

The three-color correction value generating unit 314*b* generates three-color correction values Rc, Gc and Bc of each unit pixel on the basis of the color correction mode signal CCMS having the first or second logic level supplied from the color correction mode deciding unit 314*a*, and supplies the three-color correction values Rc, Gc and Bc to the data correcting unit 314*c*.

When the color correction mode signal CCMS having the first logic level is supplied from the color correction mode deciding unit 314*a*, the three-color correction value generating unit 314*b* generates the three-color correction values Rc, Gc and Bc having a value of 0 of each unit pixel, and supplies the three-color correction values Rc, Gc and Bc to the data correcting unit 314*c*.

When the color correction mode signal CCMS having the second logic level is supplied from the color correction mode deciding unit 314*a*, the three-color correction value generating unit 314*b* generates three-color correction values Rc, Gc and Bc for correcting a color of each unit pixel on the basis of the modulation data R', G', B' and W' of each unit pixel supplied from the deterioration compensator 312, and supplies the three-color correction values Rc, Gc and Bc to the data correcting unit 314*c*. For example, the three-color correction value generating unit 314*b* calculates a color ratio value of red, green, and blue based on the white modulation data W' of each unit pixel, for each unit pixel. At this time, the three-color correction value generating unit 314*b* may generate the color ratio value of red, green, and blue to be in correspondence with a grayscale value of the white modulation data W' with reference to a lookup table. Here, the color ratio value of red, green, and blue is set based on the grayscale value of the white modulation data W' with respect to predetermined color coordinates (CIEx, CIEy) of a reference white color, and is mapped to the lookup table through previous experiment. Then, the three-color correction value generating unit 314*b* generates the three-color correction values Rc, Gc and Bc of each unit pixel according to the color ratio value of red, green, and blue of each unit pixel and a predetermined white target luminance. For example, the three-color correction value generating unit 314*b* may multiply the color ratio value of red, green, and blue and the white target luminance to generate the three-color correction values Rc, Gc and Bc having a real number value exceeding zero of each unit pixel.

The data correcting unit 314*c* corrects the modulation data R', G', B' and W' of each unit pixel supplied from the deterioration compensator 312 according to the three-color correction values Rc, Gc and Bc of each unit pixel supplied from the three-color correction value generating unit 314*b* to generate four-color correction data Ro, Go, Bo and Wo for driving three sub-pixels including the white sub-pixel or four sub-pixels for each unit pixel, and supplies the four-color correction data Ro, Go, Bo and Wo to the timing controller 320. That is, the data correcting unit 314*c* may add the modulation data R', G' and B' of red, green, and blue of each unit pixel and the three-color correction values Rc, Gc and Bc corresponding thereto to generate the four-color correction data Ro, Go, Bo and Wo. Therefore, one of the modulation data R', G' and B' of red, green, and blue of each unit pixel has a grayscale value or color correction value Rc, Gc or Bc of 0 a according to the above-described color correction mode.

Specifically, when there is no color correction mode described above, the data correcting unit 314*c* adds the modulation data R', G' and B' of red, green, and blue of each unit pixel and the three-color correction values Rc, Gc and Bc of 0 to generate the four-color correction data Ro, Go, Bo and Wo. Therefore, in the three-color correction data Ro, Go and Bo of each unit pixel, the three-color modulation data R', G' and B' from the deterioration corrector 312 are applied as-is, and thus, one of the three-color correction data Ro, Go and Bo of each unit pixel has a grayscale value of 0.

On the other hand, in the above-described color correction mode, the data correcting unit 314*c* adds the modulation data R', G' and B' of red, green, and blue of each unit pixel and the three-color correction values Rc, Gc and Bc having a real number value exceeding zero to generate the four-color correction data Ro, Go, Bo and Wo. Therefore, in the three-color correction data Ro, Go and Bo of each unit pixel, the three-color correction values Rc, Gc and Bc are respectively added to the three-color modulation data R', G' and B' from the deterioration corrector 312, and thus, all of the three-color correction data Ro, Go and Bo of each unit pixel has a grayscale value exceeding zero.

Referring again to FIG. 4, the timing controller 320 controls a driving timing of each of the gate driving circuit 330 and data driving circuit 340 according to the timing sync signal TSS inputted from the external system body (not shown) or the graphics card (not shown). That is, the timing controller 320 generates a gate control signal GCS and a data control signal DCS on the basis of the timing sync signal TSS that includes a vertical sync signal, a horizontal sync signal, a data enable signal, and a dot clock. The timing controller 320 controls the driving timing of the gate driving circuit 330 by using the gate control signal GCS, and in synchronization with this, controls the driving timing of the data driving circuit 340 by using the data control signal DCS.

Moreover, the timing controller 320 aligns the correction data Ro, Go, Bo and Wo of each unit pixel SP, supplied from the data modulator 310, to pixel data DATA so as to properly match a pixel arrangement structure of the display panel 100, and supplies the aligned pixel data DATA to the data driving circuit 340 on the basis of a specific interface type.

The timing controller 320 may include the data modulator 310. In this case, the data modulator 310 may be built into the timing controller 320, which may be built into the data modulator in the form of programs or logics.

The gate driving circuit 330 generates a gate signal GS corresponding to a display order of images on the basis of the gate control signal GCS supplied from the timing controller 320, and supplies the gate signal GS to a corresponding gate line GL. The gate driving circuit 330 may be provided in the forms of integrated circuits (ICs), or may be disposed directly on a substrate of the display panel 100 in a process of forming a transistor of each sub-pixel SP and connected to one side or both sides of each of the plurality of gate lines GL.

The data driving circuit 340 receives the pixel data DATA and the data control signal DCS from the timing controller 320, and receives a plurality of reference gamma voltages from an external reference gamma voltage supplier (not shown). The data driving circuit 340 converts the pixel data DATA into an analog data voltages Vdata by using the plurality of reference gamma voltages according to the data control signal DCS, and supplies each of the data voltages Vdata to a data line DL of a corresponding sub-pixel SP. Therefore, each unit pixel formed in the display panel 100 emits light with a data current based on the data voltage Vdata supplied to each sub-pixels SP, thereby displaying a certain image. At this time, in each unit pixel, only three sub-pixels including a white sub-pixel among red, green, and blue sub-pixels may be driven, or four sub-pixels may all be driven, according to the above-described color correction mode. The data driving circuit 340 may be provided in the forms of integrated circuits (ICs), and connected to one side or both sides of each of the plurality of data lines DL.

As described above, the organic light emitting display device and the driving method thereof compensate for the deterioration of the organic light emitting element on the basis of accumulated data of each sub-pixel, and selectively drive two or all of the red, green, and blue sub-pixels of each unit pixel according to the color correction mode based on accumulated data of the white sub-pixel of each unit pixel, thus preventing a change in color coordinates and a yellowish image due to the deterioration of the white organic light emitting element. Accordingly, image sticking caused by the change in color coordinates can be prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel arranged to include including a plurality of pixels having red, green, blue, and white sub-pixels comprising different organic light emitting elements;

a four-color data converter configured to convert input data of red, green, and blue of each of the plurality of pixels into data of red, green, blue, and white respectively corresponding to the red, green, blue, and white sub-pixels of each pixel;

a data accumulating unit, as part of a display panel driver to drive the display panel, to read a accumulated data of red, green, blue and white sub-pixels stored in a memory, accumulate the data of the red, green, blue, and white sub-pixels supplied from the four-color data converter to the data read from the memory at every accumulation period and store the accumulated data of the red, green, blue, and white sub-pixels in the memory, and a color correction mode deciding unit configured to determine a color correction mode, a mode of driving the plurality of pixels in the display panel for correcting a color of each pixel on the basis of the accumulated data of the white sub-pixel stored in the memory, wherein the white sub-pixel of each pixel is driven and the red, green, and blue sub-pixels are selectively driven with the driving of the white sub-pixel according to the determined color correction mode.

2. The organic light emitting display device of claim 1, wherein, when in the color correction mode, all of the red, green, blue, and white sub-pixels of each pixel are simultaneously driven, and when not in the color correction mode, two of the red, green, and blue sub-pixels of each pixel and a white sub-pixel are simultaneously driven.

3. The organic light emitting display device of claim 1 further comprising:

a deterioration compensation value calculating unit to calculate a deterioration compensation gain value of each sub-pixel for compensating for a deterioration of the organic light emitting element of each sub-pixel on the basis of the accumulated data of each sub-pixel; and a data modulating unit to modulate converted data of each sub-pixel according to the deterioration compensation gain value to further generate modulation data of each sub-pixel.

4. The organic light emitting display device of claim 3, further comprising:

a three-color correction value generating unit to generate color correction values of red, green, and blue for color-correcting the modulation data of red, green, and blue of each pixel according to the determined color correction mode.

5. The organic light emitting display device of claim 4, wherein the color correction mode deciding unit compares the accumulated data of the white sub-pixel with a predetermined white deterioration reference value to generate a first or a second color correction mode signal based on the comparison result, and wherein the three-color correction value generating unit generates color correction values of red, green, and blue having a value of zero when a color correction mode signal having a first logic level is supplied from the color correction mode deciding unit, and when a color correction mode signal having a second logic level is supplied from the color correction mode deciding unit, generate color correction values of red, green, and blue having a real number value exceeding zero on the basis of the white modulation data of each pixel.

6. A method of driving an organic light emitting display device, including a pixel that includes red, green, blue, and white sub-pixels having different organic light emitting elements, the method comprising:

converting input data of red, green, and blue of the pixel into data of red, green, blue, and white respectively corresponding to the red, green, blue, and white sub-pixels of the pixel;

accumulating data by reading a data of red, green, blue, and white sub-pixels stored in a memory, accumulating the data of the red, green, blue, and white sub-pixels supplied from the four-color data converter to the data read from the memory at every accumulation period, and storing the accumulated data of the red, green, blue, and white sub-pixels in the memory; and determining a color correction mode, a mode of driving the pixel for correcting a color of the pixel on the basis of the accumulated data of the white sub-pixel stored in the memory, and driving the white sub-pixel and selectively driving the red, green, and blue sub-pixels simultaneously with the driving of the white sub-pixel according to the determined color correction mode.

7. The method of claim 6, wherein the determining a color correction mode comprises:

when there is the color correction mode, simultaneously driving all of the red, green, blue, and white sub-pixels; and when there is no color correction mode, simultaneously driving two of the red, green, and blue sub-pixels and a white sub-pixel.

8. The method of claim 6, further comprising:

calculating a deterioration compensation gain value of each sub-pixel for compensating for a deterioration of the organic light emitting element of each sub-pixel on the basis of the accumulated data of each sub-pixel, and modulating converted data of each sub-pixel according to the deterioration compensation gain value to further generate modulation data of each sub-pixel.

9. The method of claim 8, wherein the determining a color correction mode comprises:

comparing the accumulated data of the white sub-pixel with a predetermined white deterioration reference value to generate a first or a second color correction mode signal for deciding the color correction mode according to a compared result; and selectively color-correcting the modulation data of the red, green, and blue sub-pixels according to the first or the second color correction mode signal, driving the white sub-pixel, and generating correction data of red, green, blue, and white for selectively driving the red, green, and blue sub-pixels simultaneously with the driving of the white sub-pixel.

10. The method of claim 9, wherein the selectively color-correcting the modulation data comprises:

generating color correction values of red, green, and blue having a value of zero according to the color correction mode signal having a first logic level, or generating color correction values of red, green, and blue having a real number value exceeding zero on the basis of the white modulation data of the pixel according to the color correction mode signal having a second logic level; and reflecting the color correction values of red, green, and blue respectively corresponding to the modulation data of red, green, and blue to generate the correction data of red, green, blue, and white.

11. The organic light emitting display device of claim 4, further comprising:

a data correcting unit to color-correct the modulation data of red, green, and blue of each pixel according to the color correction values of red, green, and blue supplied from the three-color correction value generating unit to generate correction data of red, green, blue, and white of each pixel, wherein the red, green, blue, and white sub-pixels of each pixel are driven according to the correction data of red, green, blue, and white of each pixel.

* * * * *